US007944153B2

(12) United States Patent
Greenfeld

(10) Patent No.: US 7,944,153 B2
(45) Date of Patent: May 17, 2011

(54) CONSTANT CURRENT LIGHT EMITTING DIODE (LED) DRIVER CIRCUIT AND METHOD

(75) Inventor: Fred Greenfeld, Nederland, CO (US)

(73) Assignee: Intersil Americas Inc., Milpitas, CA (US)

( * ) Notice: Subject to any disclaimer, the term of this patent is extended or adjusted under 35 U.S.C. 154(b) by 706 days.

(21) Appl. No.: 12/002,611

(22) Filed: Dec. 17, 2007

(65) Prior Publication Data

US 2008/0224625 A1 Sep. 18, 2008

Related U.S. Application Data

(60) Provisional application No. 60/875,075, filed on Dec. 15, 2006.

(51) Int. Cl.
*G05F 1/00* (2006.01)

(52) U.S. Cl. ..... 315/291; 315/224; 315/308; 315/312; 323/277; 323/280; 323/282

(58) Field of Classification Search ..... 315/291, 315/312, 307, 308, 224, 247, 169.1; 323/222, 323/224, 277, 280, 282, 207; 363/21.09, 363/21.1, 21.12, 21.17, 21.18, 101, 123; 345/82, 102, 212
See application file for complete search history.

(56) References Cited

U.S. PATENT DOCUMENTS

| | | | | |
|---|---|---|---|---|
| 5,614,810 | A * | 3/1997 | Nostwick et al. | 323/207 |
| 5,682,306 | A * | 10/1997 | Jansen | 363/89 |
| 6,466,188 | B1 * | 10/2002 | Cato | 345/82 |
| 6,596,977 | B2 * | 7/2003 | Muthu et al. | 250/205 |
| 7,202,608 | B2 * | 4/2007 | Robinson et al. | 315/224 |
| 7,425,803 | B2 * | 9/2008 | Shao et al. | 315/308 |
| 7,542,257 | B2 * | 6/2009 | McCormick et al. | 361/91.1 |
| 2007/0080911 | A1 * | 4/2007 | Liu et al. | 345/82 |

* cited by examiner

*Primary Examiner* — Haissa Philogene
(74) *Attorney, Agent, or Firm* — Paul A. Bernkopf; Graybeal Jackson LLP; Paul F. Rusyn

(57) ABSTRACT

A drive circuit supplies a drive current to a plurality of light emitting diodes. The drive circuit includes a voltage converter circuit having a particular topology and including at least one inductive element and at least one switching element. The drive circuit senses a current through one of the inductive and switching elements and generates a feedback signal from the sensed current. The feedback signal has a value indicating the drive current being supplied to the light emitting diodes and the drive circuit controls the operation of the voltage converter responsive to the feedback signal.

27 Claims, 11 Drawing Sheets

CONSTANT CURRENT LIGHT EMITTING DIODE (LED) DRIVER CIRCUIT AND METHOD

PRIORITY CLAIM

The present application claims the benefit of U.S. Provisional Patent Application No. 60/875,075, filed Dec. 15, 2006, which application is incorporated herein by reference in its entirety.

TECHNICAL FIELD

The present invention relates generally to lighting systems, and more specifically to light emitting diode (LED) lighting systems.

BACKGROUND

Light emitting diodes (LED) have reached performance levels that enable such LEDs to be utilized in applications that were not previously possible, such as industrial and consumer lighting applications in which incandescent and fluorescent lighting systems have typically been utilized for many years. When used in these industrial and consumer applications, LED lighting systems ideally will be easily interchangeable with these prior lighting systems to gain acceptance and utilization in these types of applications. For example, these prior lighting systems receive power from alternating current (AC) power sources and provide some level of power factor correction such that the lighting system effectively presents a resistive load to the power source. LED lighting systems should also be operable from AC power sources and provide the desired power factor correction.

In contrast to conventional lighting systems, however, LED lighting systems require a constant current be supplied through the LEDs to provide the desired illumination. Typically a large number of LEDs are connected in series and parallel combinations to provide the desired illumination. A variety of different types of voltage converters have been utilized in prior systems to drive LED lighting systems in the required manner and thereby provide the required constant current to achieve the desired illumination. FIG. 1 is a circuit diagram showing a conventional LED drive circuit that is formed by a synchronous Buck converter drive circuit 100 for converting an input voltage $V_{in}$ into an output voltage $V_{out}$ desired for driving one or more series-connected LEDs 102.

In operation, an inductor current IL1 flows through an inductor L1 when a first switching transistor Q1 is turned ON and a second switching transistor is turned OFF. A switching control circuit 104 applies drive controls signals DCS1 and DCS2 to control the activation and deactivation of switching transistors Q1 and Q2. The switching control circuit 104 drives the DCS1 signal active and the DCS2 signal inactive to turn the transistor Q1 on and the transistor Q2 OFF. During this mode of operation, the current IL1 flows through the inductor L1 and charges a load or output capacitor COUT to develop an output voltage VOUT across the capacitor and thereby across the series-connected LEDs 102.

During a second mode of operation, the control circuit 104 deactivates DCS1 and activates DCS2, turning the transistors Q1 and Q2 OFF and ON, respectively. In this mode, with the transistor Q1 turned OFF and Q2 turned ON the voltage developed across the inductor L1 supplies current through the transistor Q2 to maintain the current IL1 through the inductor L. The conventional operation of the Buck converter drive circuit 100 is well understood by those skilled in the art and thus, for the sake of brevity, will not be described in more detail herein.

The control circuit 104 pulse width modulates the DCS1 and DCS2 to define a duty cycle D for the transistor Q1, with the duty cycle being defined by an on-time TON corresponding to the duration of a period T of the DCS1 signal for which the transistor is turned ON. More specifically, the duty cycle D is given by D=TON/T. The voltage developed across the output capacitor COUT corresponds to the output voltage VOUT from the drive circuit 100 and an output current IOUT from the output capacitor drives the series-connected LEDs 102 to provide current through these LEDs to achieve the desired illumination intensity.

A current transducer 106 is connected in series with the LEDs 102 and functions to generate a feedback voltage signal VFB having a value that is a function of the output current IOUT flowing through the series-connected LEDs 102. The control circuit 104 receives the feedback voltage signal VFB and utilizes this signal in generating the pulse width modulated signals DCS1 and DCS2 to control the duty cycle D of the transistors Q1 and Q2 and the overall operation of the Buck converter drive circuit 100. The feedback voltage VFB has a value that is a function of the current IOUT through the LEDs 102 and in this way enables the switching control circuit 104 to control this current. In this way, the current transducer 106 directly senses the current flowing through the series-connected LEDs 102. With the approach of FIG. 1, a suitable current transducer 106, such as a sense resistor or Hall Effect device, is utilized to sense the output current IOUT. The current transducer 106 increases the parts count of the Buck converter drive circuit 100, which increases the size and cost of the drive circuit.

There is a need for improved driver circuits and methods for controlling LED lighting systems.

SUMMARY

According to one embodiment of the present invention, a drive circuit supplies a drive current to a plurality of light emitting diodes. The drive circuit includes a voltage converter circuit having a particular topology and including at least one inductive element and at least one switching element. The drive circuit senses a current through one of the inductive and switching elements and generates a feedback signal from the sensed current. The feedback signal has a value indicating the drive current being supplied to the light emitting diodes and the drive circuit controls the operation of the voltage converter responsive to the feedback signal.

Another embodiment of the present invention is directed to a method of controlling a drive current being supplied to a plurality of light emitting diodes. The drive current is generated by a voltage converter including switching and inductive elements. The method includes sensing a current through a selected one of the inductive and switching elements, determining the average current through the selected one of the inductive and switching elements, and controlling the drive current responsive to the determined average current.

DETAILED DESCRIPTION

Figure 2A:
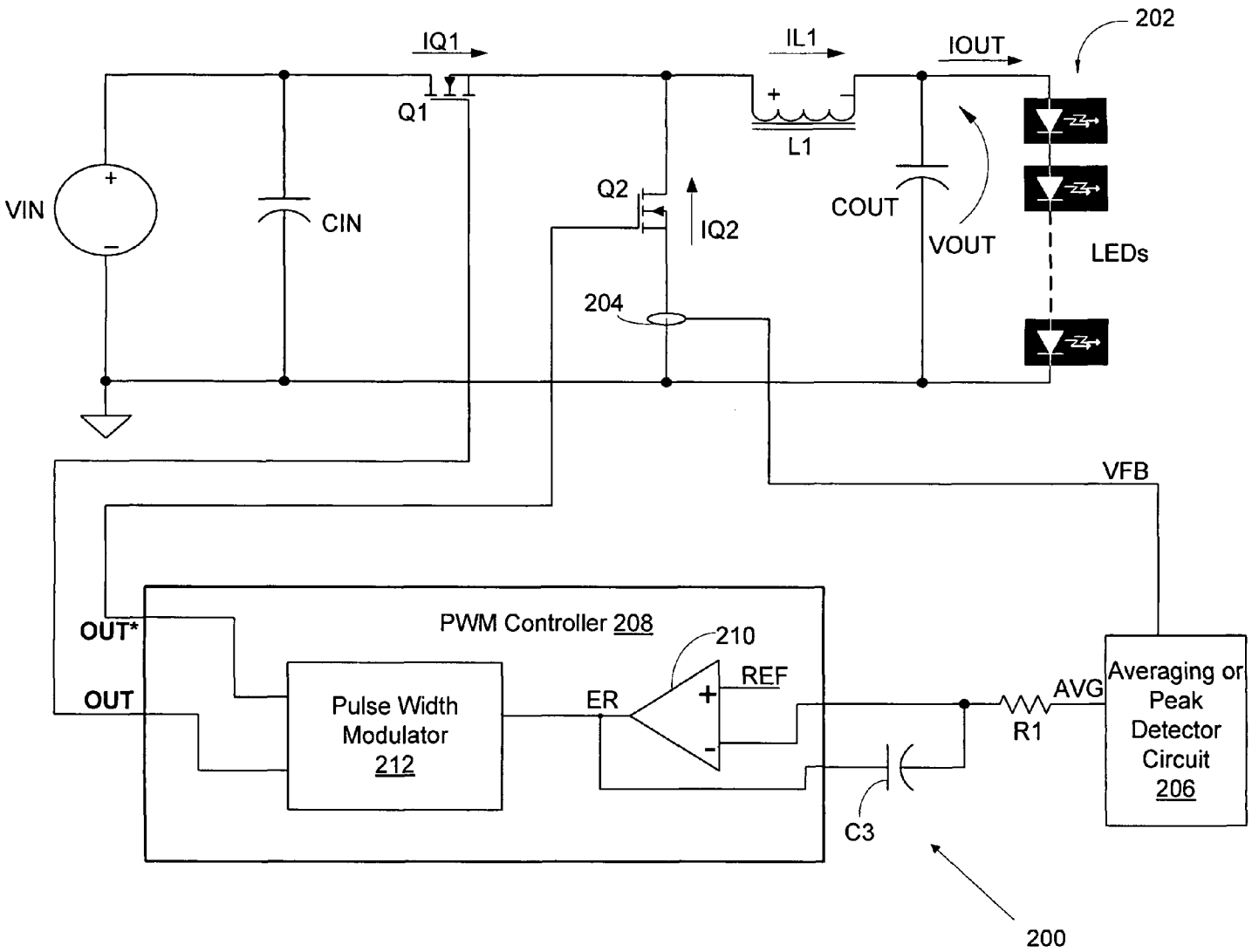
FIG. 2A is a circuit diagram illustrating a Buck-type drive circuit for driving a number of series-connected LEDs according to one embodiment of the present invention.

FIG. 2A is a circuit diagram illustrating a Buck-type drive circuit 200 for driving a number of series-connected LEDs 202 according to one embodiment of the present invention. The converter 200 includes first and second switching transistors Q1 and Q2 and a current transducer 204 coupled in series with the second switching transistor Q2 to generate a voltage feedback signal VFB having a value that is a function of a current IQ2 flowing through a second switching transistor. Because the current IQ2 has a value that is functionally related to the value of a drive, load or output current IOUT flowing through the series-connected LEDs 202, the current IQ2 may be utilized to control the output current IOUT flowing through the LEDs 202, as will be explained in more detail below. Using the current IQ2 enables the drive circuit 200 to control the LEDs 202 through pulse width modulation (PWM) techniques without direct measurement of the output current IOUT through the LEDs, as will also be described in more detail below.

In the present description, certain details are set forth in conjunction with the described embodiments of the present invention to provide a sufficient understanding of the invention. One skilled in the art will appreciate, however, that the invention may be practiced without these particular details. Furthermore, one skilled in the art will appreciate that the example embodiments described below do not limit the scope of the present invention, and will also understand that various modifications, equivalents, and combinations of the disclosed embodiments and components of such embodiments are within the scope of the present invention. Embodiments including fewer than all the components of any of the respective described embodiments may also be within the scope of the present invention although not expressly described in detail below. Finally, the operation of well known components and/or processes has not been shown or described in detail below to avoid unnecessarily obscuring the present invention.

The drive circuit 200 receives an input voltage VIN that is applied across a capacitor CIN, which functions as a filter where the input voltage is DC source and which represents suitable rectifying circuitry where the input voltage is an AC source. The value of input capacitor CIN will vary greatly depending on the desired behavior of the circuit. If energy storage is required, the value of CIN will be large. If input voltage VIN is derived from an AC source and power factor correction (PFC) is desired, the input capacitor CIN will be very much smaller. An output capacitor COUT receives a current IL1 that flows through an inductor L1 and is coupled across the series-connected LEDs 202 and supplies the output current IOUT to the LEDs 202 at certain times during the operation of the Buck converter. As will be appreciated by those skilled in the art, the Buck converter topology is more precisely a synchronous Buck converter topology.

The drive circuit 200 also includes an averaging or peak detector circuit 206 that receives a feedback voltage signal VFB developed by the current transducer 204. In response to the VFB signal, the detector circuit 206 develops an output signal indicating the average or peak value of a current IQ2 flowing through the second switching transistor Q2. For the following description, the detector circuit 206 is assumed to be an average detector circuit and so the output signal from the detector circuit 206 is thus designated in FIG. 2A as an average signal AVG. The AVG signal is applied through a resistor R1 and capacitor C3 to an inverting input of an error amplifier 210. The error amplifier 210 receives a reference voltage REF on a non-inverting input and operates to integrate the difference between the AVG signal and the reference signal and generate a corresponding error signal ER. The error signal ER is output to a PWM modulator 212 which uses this error signal to generate complementary pulse width modulated control output signals OUT, OUT* to control the turning ON and OFF of the switching transistors Q1 and Q2. Those skilled in the art will understand the detailed operation of the PWM modulator 212 and the overall detailed operation of the Buck converter and therefore, for the sake of brevity, the overall operation and theory of such operation will not be described in detail herein.

The drive circuit 200 uses average current supplied to the output capacitor COUT to regulate the load or output current IOUT supplied to the series-connected LEDs 202. More specifically, during each cycle of the drive circuit 200, the switching current IQ2 through the transistor Q2 is sensed by the current transducer 204, where a cycle corresponds to an ON/OFF period of the switching transistor Q1, as will be discussed in more detail below. During an ON duration of each cycle, the switching current IQ2 flows through the transistor Q2 and is sensed by the current transducer 204, which develops the voltage feedback signal FB having a value that is a function of this switching current. In response to the voltage feedback signal FB, the detector circuit 206 generates the average current signal AVG indicating the average value of the switching current IQ2 during this cycle or ON/OFF period of the transistor Q. As will be appreciated by those skilled in the art, the switching current IQ2 will have a triangular shape and thus the detector circuit 206 may either provide a peak of this triangular wave form and divide this peak value by two, in the case of critical conduction mose operation, to generate the average current signal or may perform actual averaging of the switching current to generate the average current signal. One skilled in the art will understand suitable circuitry for forming the detector circuit 206.

In response to the average current signal AVG, the PWM controller 208 pulse width modules the control output signals OUT, OUT* to thereby pulse with modulate the switching transistors Q1 and Q2. This pulse width modulation of the transistors Q1 and Q2 controls current IL1 through the inductor L1, which is the current into the output capacitor COUT. This is true because during steady-state operation, the current IL1 supplied to the output capacitor COUT via the inductor L1 must be equal to the current provided by the output capacitor to the LEDs. As a result, sensing and controlling the current IL1 flowing into the capacitor COUT controls the output current IOUT flowing through the series-connected LEDs 202, as will now be described in more detail with reference to FIG. 2B.

Figure 2B:
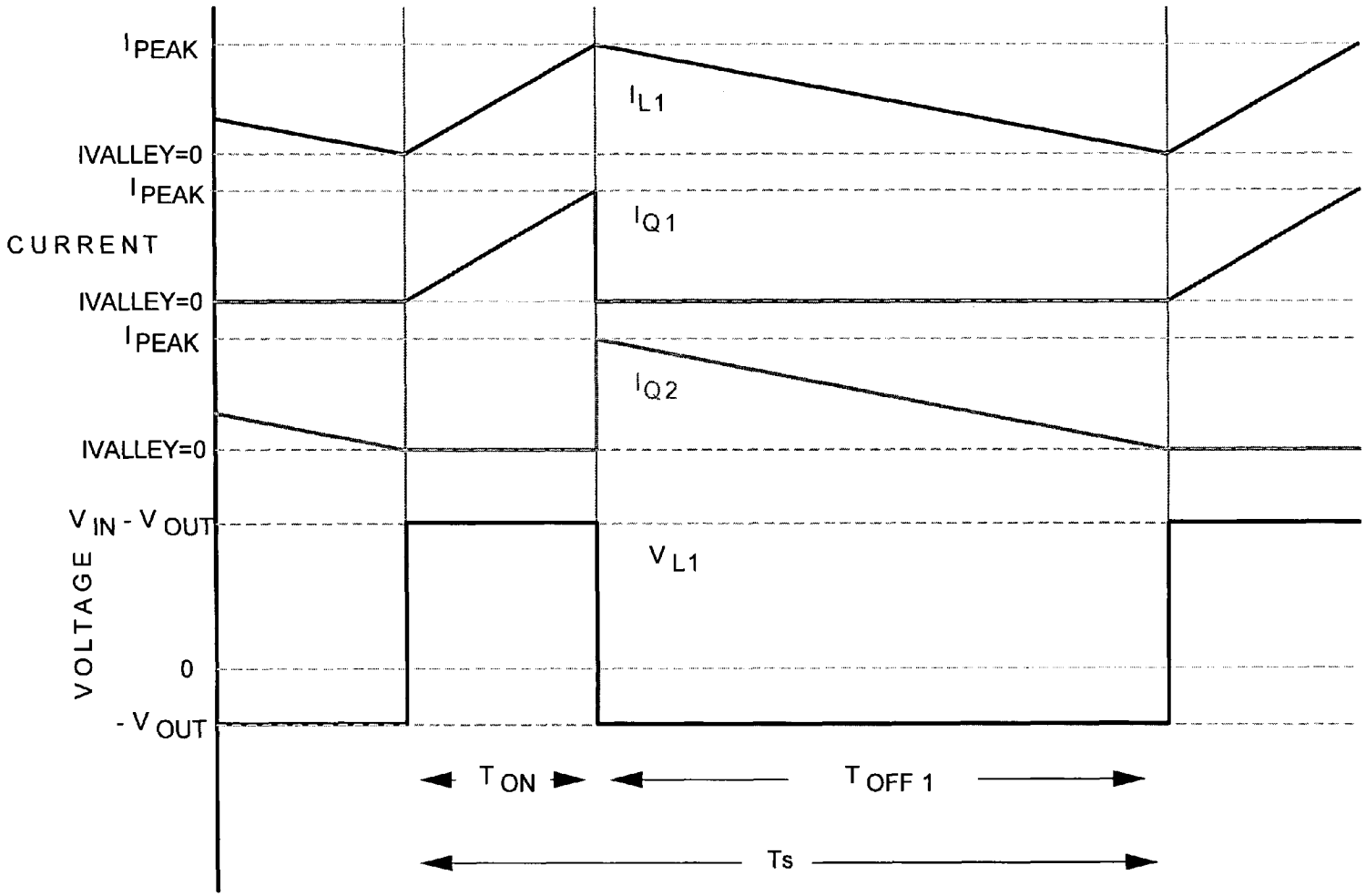
FIG. 2B is a signal diagram showing voltages and currents developed in the Buck-type drive circuit of FIG. 2A during the critical conduction mode of operation.

FIG. 2B is a signal diagram showing voltages and currents developed in the Buck-type drive circuit 200 of FIG. 2A during the critical conduction mode of operation. The diagram shows, for one cycle of the driver circuit 200, the waveforms for the current IL1 flowing through the inductor L1 and the switching currents IQ1 and IQ2 flowing through the switching transistors Q1 and Q2, along with the output voltage VOUT across the capacitor COUT.

The current in the inductor IL1 ramps up during a time TON when the switching transistor Q1 is turned ON and transistor Q2 is turned OFF. Current IL1 ramps down during a time TOFF1 corresponding to the time when the switching transistor Q1 is turned OFF and transistor Q2 is turned ON. A period or cycle corresponds to the sum of these two times, and is designated TS in FIG. 2B such that TS=TON+TOFF1. The cycle repeats when the inductor current IL1 reaches zero, which indicates operation in the critical conduction mode (CRCM) of operation. The direction of positive current flow is depicted by the arrows adjacent to the relative components in FIG. 2A. The polarity of the inductor L1 is indicated by the plus and minus signs.

In the Buck converters, as is known in the art, the output current IOUT delivered to the load, in this case the LEDs 202, is equal to the average current in the inductor L1, regardless of mode of operation of the Buck converter (i.e., discontinuous conduction mode (DCM), critical conduction mode (CRCM) or continuous conduction mode (CCM)). Moreover, the average inductor current in L1, designated $\bar{I}_{L1}$, can be easily calculated using simple mathematics and found to be:

$$\bar{I}_{L1} = \frac{1}{2}(I_{PEAK} + I_{VALLEY})$$

where $I_{PEAK}$ and $I_{VALLEY}$ are values for the inductor current IL1 as designated in FIG. 2B. This is understood from an intuitive standpoint by noting that for each period TON and TOFF the average value of the current IL1 is equal to and $I_{VALLEY}+\frac{1}{2}(I_{PEAK}-I_{VALLEY})$, which equals the equation set forth above. Thus, this shows that the average current $\bar{I}_{L1}$ through the inductor L1 can be utilized to measure the output current IOUT through the LEDs 202. In the case of the CRCM mode of operation, $I_{VALLEY}=0$ For the CCM and CRCM modes of operation the average inductor current can be determined by passing the output of a current transducer 204 in series with L1 into a low pass filter, such as a resistor-capacitor network or other filter can be used as the detector circuit 206 to yield the AVG signal. In one embodiment, the current transducer 204 monitors current IL1 through the inductor IL1. In the case of the synchronous Buck converter of FIG. 2A, this technique also applies to DCM operation.

Sensing the current IL1 through the inductor L1 may not be as convenient as sensing the current through one of the switching transistors, Q1 or Q2, in some applications. In the embodiment of FIG. 2A, for example, the current transducer 204 senses current IQ2 through the transistor Q2. This can be done because, as shown in FIG. 2B, if the peak current $I_{PEAK}$ and the valley current $I_{VALLEY}$ occur for the current IQ2 during each cycle TS. The same is true for the current IQ1 through the transistor Q1. As a result, a sample and hold circuit could, for example, be utilized to sample these currents (i.e., sample the feedback voltage VFB generated by the current transducer 204 sensing these currents) and then sum the two samples and multiply that sum by 0.5 to yield the desired average current value, which corresponds to the output current IOUT.

Figure 2C:
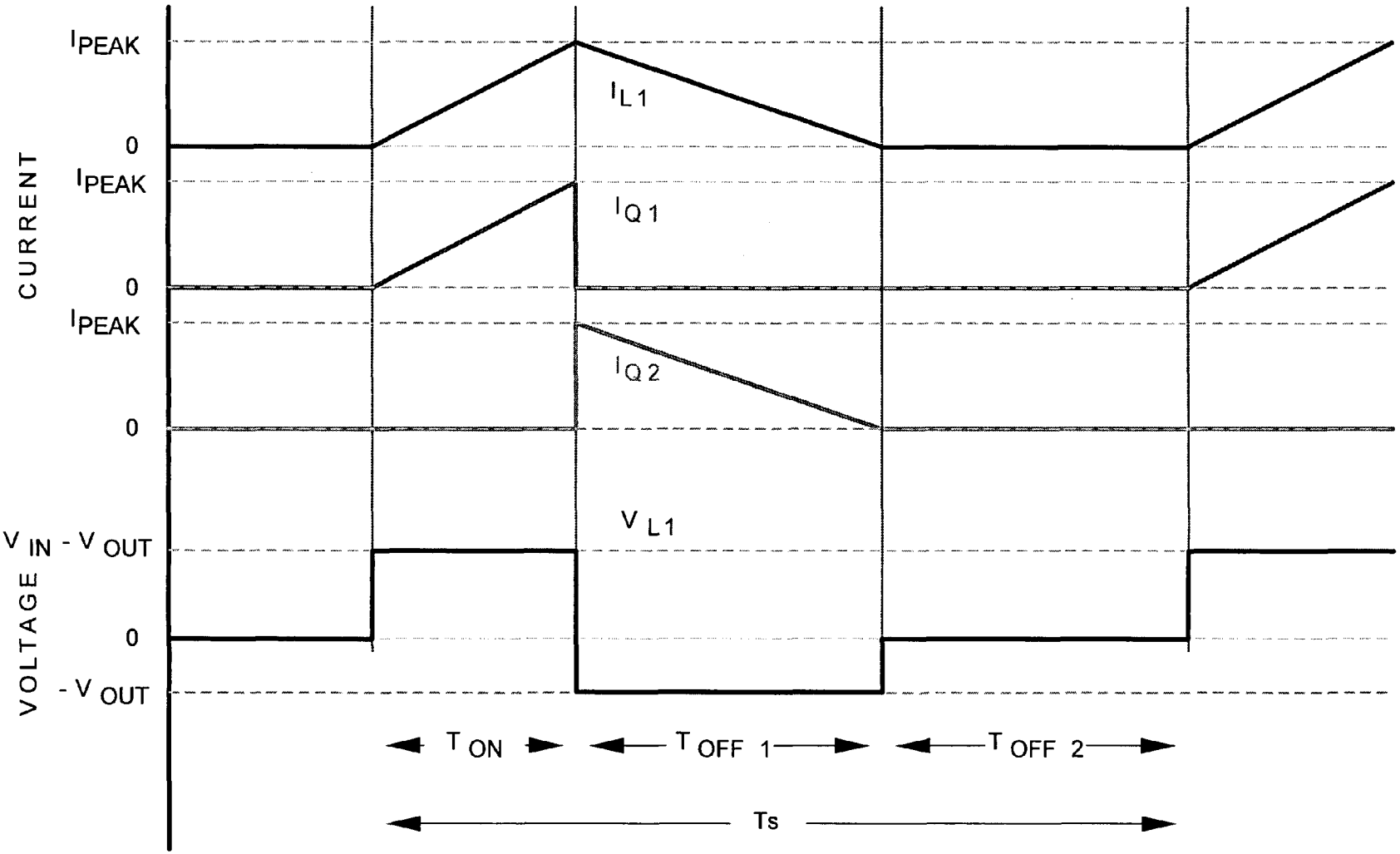
FIG. 2C is a signal diagram showing voltages and currents developed in the Buck-type drive circuit of FIG. 2A during the discontinuous mode of operation.

When operating in discontinuous conduction mode (DCM), the signal waveforms for the drive circuit 200 of FIG. 2A are shown in FIG. 2C. In this embodiment, the Buck converter contained in the drive circuit 200 is a non-synchronous Buck converter so the switching transistor Q2 is replaced with a diode. In the DCM mode, current does not flow through the inductor L1 during the entirety of a cycle TS, but instead the current IL1 goes to zero prior to the end of the cycle. Thus, as shown in FIG. 2C the waveforms for IL1, IQ1, and IQ2 look like those for the DRCM mode of FIG. 2B during times TON and TOFF1 of the cycle TS, but then after TOFF1 a third portion of the cycle TOFF2 commences and the current IL1 is zero during this portion of the cycle.

In the DCM mode, the average inductor current $\bar{I}_{L1}$ can still be determined placing a current transducer 204 in series with the inductor L1. The output signals VFB from this transducer 204 is then fed into a low pass filter that forms the detector circuit 206. Such a low pass filter may be a resistor-capacitor network or other filter as known in the art. The output from the filter will yield the average value AVG in this situation. Determining the average inductor current $\bar{I}_{L1}$ by monitoring the either switch current IQ1, IQ2 in the DCM mode of operation is more challenging, but can be done as follows. In this situation, the average inductor current for a non-synchronous Buck converter becomes:

$$\bar{I}_{L1} = \frac{1}{2}\frac{I_{PEAK}(T_{ON} + T_{OFF1})}{(T_{ON} + T_{OFF1} + T_{OFF2})} = \frac{1}{2}\frac{I_{PEAK}(T_{ON} + T_{OFF1})}{T_S}$$

As seen from this equation, sensing the current through one of the switching elements, Q1 or Q2, to determine the average inductor current requires knowing the duration of each time intervals TON, TOFF1, and TOFF2, which vary with the particular operating conditions of the circuit 200 at any given point in time. Thus, suitable hardware circuitry or a combination of hardware and software may be utilized to implement the above equation. Such hardware circuitry is likely more costly than measuring the inductor current IL1 directly, and thus from a pragmatic standpoint operation in the CRCM or CCM modes rather than the DCM may be more desirable.

The above discussion and description apply for the synchronous Buck topologies like shown in FIG. 2A, and when operating in any of the modes CCM, CRCM, and DCM. In non-synchronous Buck converter topologies, the transistor Q2 is replaced with a diode. In this situation determining the average inductor current $\bar{I}_{L1}$ by measuring the current through either switching transistor Q1 or Q2 can be done but becomes more complicated.

In operation of the drive circuit 200, the output current IOUT is sensed via the transducer 204 on a cycle-by-cycle basis (i.e., each cycle TS) of the drive circuit. The sensed current IQ2 is converted to the VFB signal representative of the current IQ2. Those skilled in the art will also understand the detailed operation of the PWM controller 208 illustrated in FIG. 2A and so this operation will likewise also not be described in detail herein. Also note that the specific components of the PWM controller 208 are merely included as an example in FIG. 2A, and other suitable PWM control circuits can be utilized in other embodiments of the present invention.

Figure 3A:
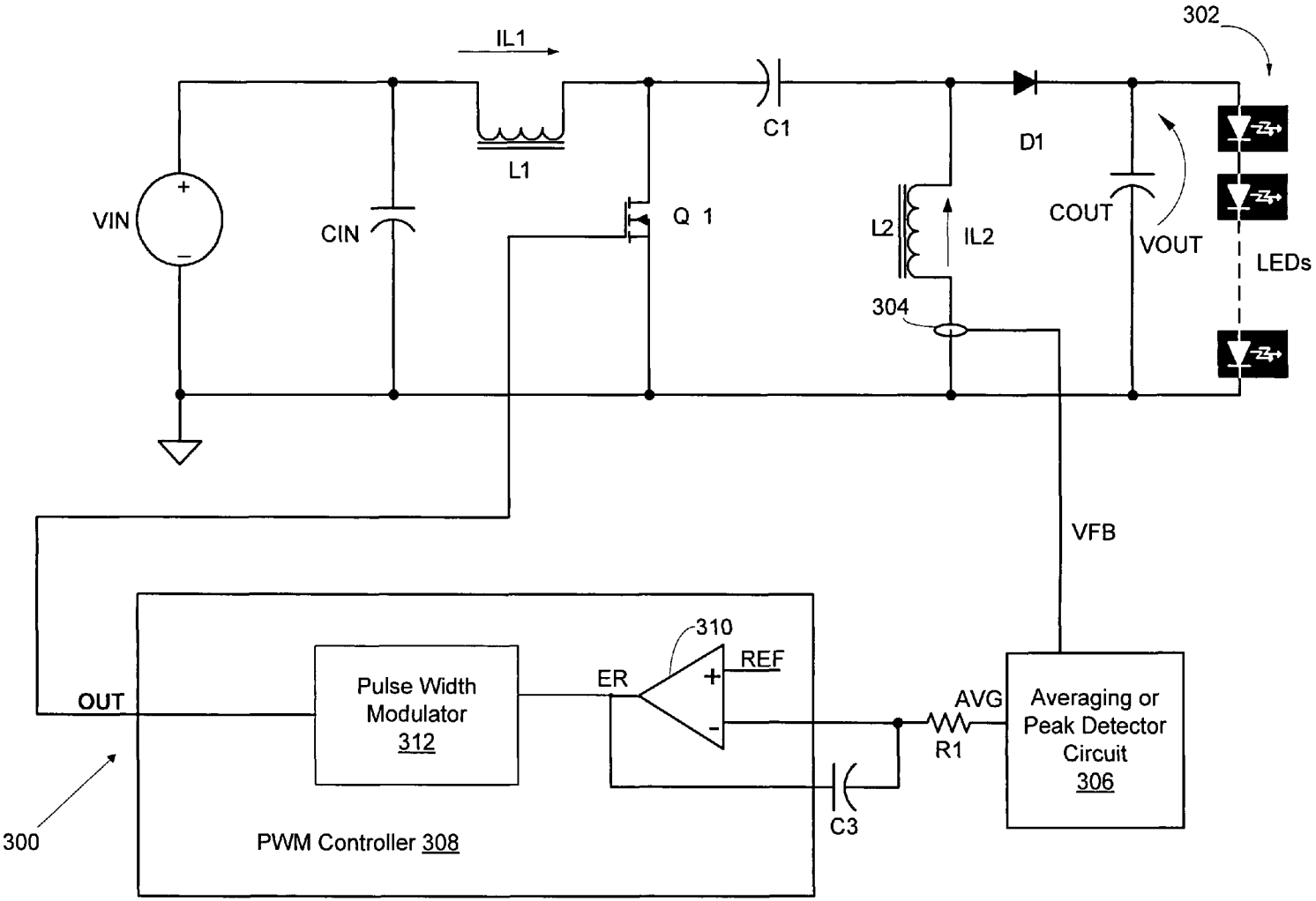
FIG. 3A is a circuit diagram illustrating a single ended primary inductance converter (SEPIC) driver circuit for driving a number of series-connected LEDs according to another embodiment of the present invention.

FIG. 3A is a circuit diagram illustrating single ended primary inductance converter (SEPIC) type driver circuit 300 for driving a number of series-connected LEDs 302 according to another embodiment the present invention. The SEPIC converter topology allows the driver circuit 300 to generate an output voltage VOUT that is greater than, less than, or equal to an input voltage VIN, as will be understood by those skilled in the art. The operation of the SEPIC type drive circuit 300 is similar to the operation of the Buck type drive circuit 200 previously described with reference to FIGS. 2A-2C and thus, for the sake of brevity, the detailed operation of the drive circuit 300 will not be described in more detail herein. Briefly, the SEPIC type drive circuit 300 includes a single switching transistor Q1, two inductive elements L1 and L2, input and output capacitors CIN and COUT, an input voltage source that supplies input voltage VIN, intermediate capacitor C1 and a diode D1 interconnected as shown to form an SEPIC type voltage converter. A current transducer 304 senses current IL2 flowing through the inductive element L2 and generates a feedback voltage signal VFB having a value that is a function of the current IL2.

An averaging or peak detector circuit 306 receives the VFB signal and generates an output signal indicating the average or peak value of the current IL2. In the example of FIG. 3A the detector circuit 306 generates an average signal AVG having a value corresponding to the average of the current IL2 through the inductor element L2. A PWM controller 308 includes components 310-318 that operate in a manner analogous to the corresponding components 210-218 previously described with reference to the PWM controller 208 of FIG. 2A. output of the NOR gate 318 generates a control output signal OUT is applied to control the activation and deactivation of the switching transistor Q1.

Figure 3B:
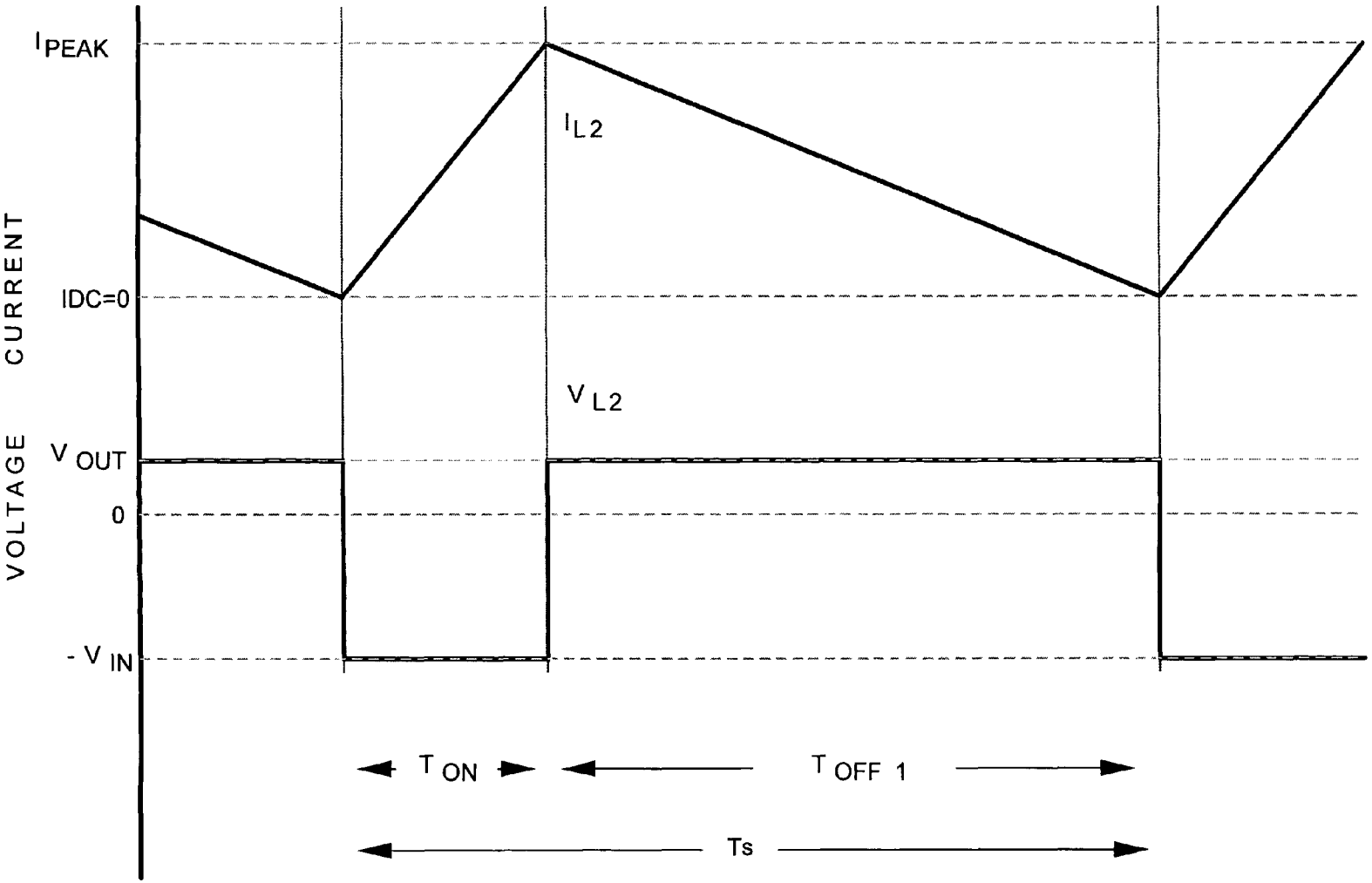
FIG. 3B is a signal diagram showing voltages and currents developed in the SEPIC-type drive circuit of FIG. 3A during the critical conduction mode of operation.

The operation of the drive circuit 300 will now be described in more detail with reference to FIGS. 3B-3D, which are signal diagrams of illustrating the operation of the drive circuit during the CRCM, DCM and CCM modes of operation, respectively. The ideal waveforms for the current IL2 flowing through the inductive element L2 in the SEPIC converter operating in the CRCM mode are shown in FIG. 3B. In operation of the drive circuit 300 in the CRCM mode, the current in the inductor L2 ramps up during a time TON when the switching transistor Q1 is turned ON and ramps down during a time TOFF1 when switching transistor Q1 turned OFF. The sum of TON+TOFF1 once again defines the cycle TS. The cycle TS repeats when the inductor current IL2 reaches $I_{DC}$, indicating operation of the circuit 300 in the critical conduction mode (CRCM). The direction of positive current flow is depicted by the arrow adjacent to L2 in FIG. 3A and the voltages indicated in FIG. 3B for VIN and VOUT are with respect to circuit ground. In the SEPIC converter contained in the drive circuit 300, an output current IOUT delivered to the load or output capacitor COUT is equal to the average current in the inductor L2. Once again, the average inductor current in the inductor L2, which is designated $\bar{I}_{L2}$, can easily be calculated using simple mathematics and found to be equal to:

$$\bar{I}_{L2} = \frac{1}{2} I_{PEAK} + I_{DC}$$

where the current $I_{DC}$ is a DC current that varies with the actual operating conditions, and may be either positive, negative, or zero. In the example of FIG. 3B the current $I_{DC}$=0. The average inductor current $\bar{I}_{L2}$ can be determined by supplying the feedback voltage signal VFB from the current transducer 304 to the detector circuit 306, which is a low pass filter such as a resistor-capacitor network or other type of filter known the art to yield the average value.

Figure 3C:
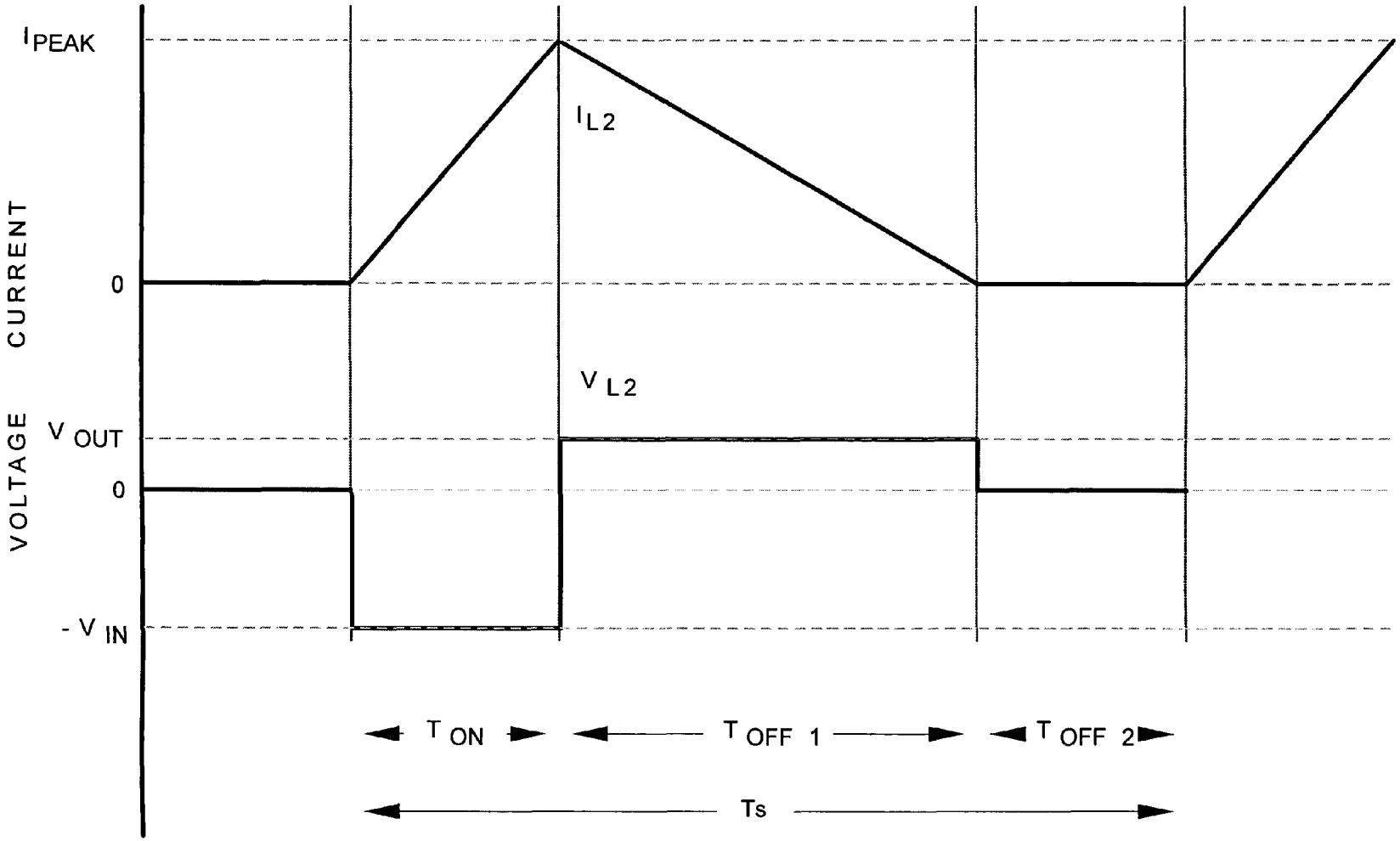
FIG. 3C is a signal diagram showing voltages and currents developed in the SEPIC-type drive circuit of FIG. 3A during the discontinuous conduction mode of operation.

FIG. 3C is a signal diagram illustrating the operation of the SEPIC converter in the drive circuit 300 during the DCM mode of operation. When operating in the DCM mode, the load or output current IOUT is still equal to the average value $\bar{I}_{L2}$ of the inductor current IL2 flowing in the inductor L2 and is given by the following equation:

$$\bar{I}_{L2} = \frac{1}{2}\frac{I_{PEAK}(T_{ON} + T_{OFF1})}{(T_{ON} + T_{OFF1} + T_{OFF2})} + I_{DC} = \frac{1}{2}\frac{I_{PEAK}(T_{ON} + T_{OFF1})}{T_S} + I_{DC}$$

where $I_{DC}$ is once again a DC current that varies with the actual operating conditions and is equal to zero in the example of FIG. 3C. The average inductor current $\bar{I}_{L2}$ may once again be determined by supplying the VFB signal to the detector circuit 306 which may be formed by a low pass filter circuit.

Figure 3D:
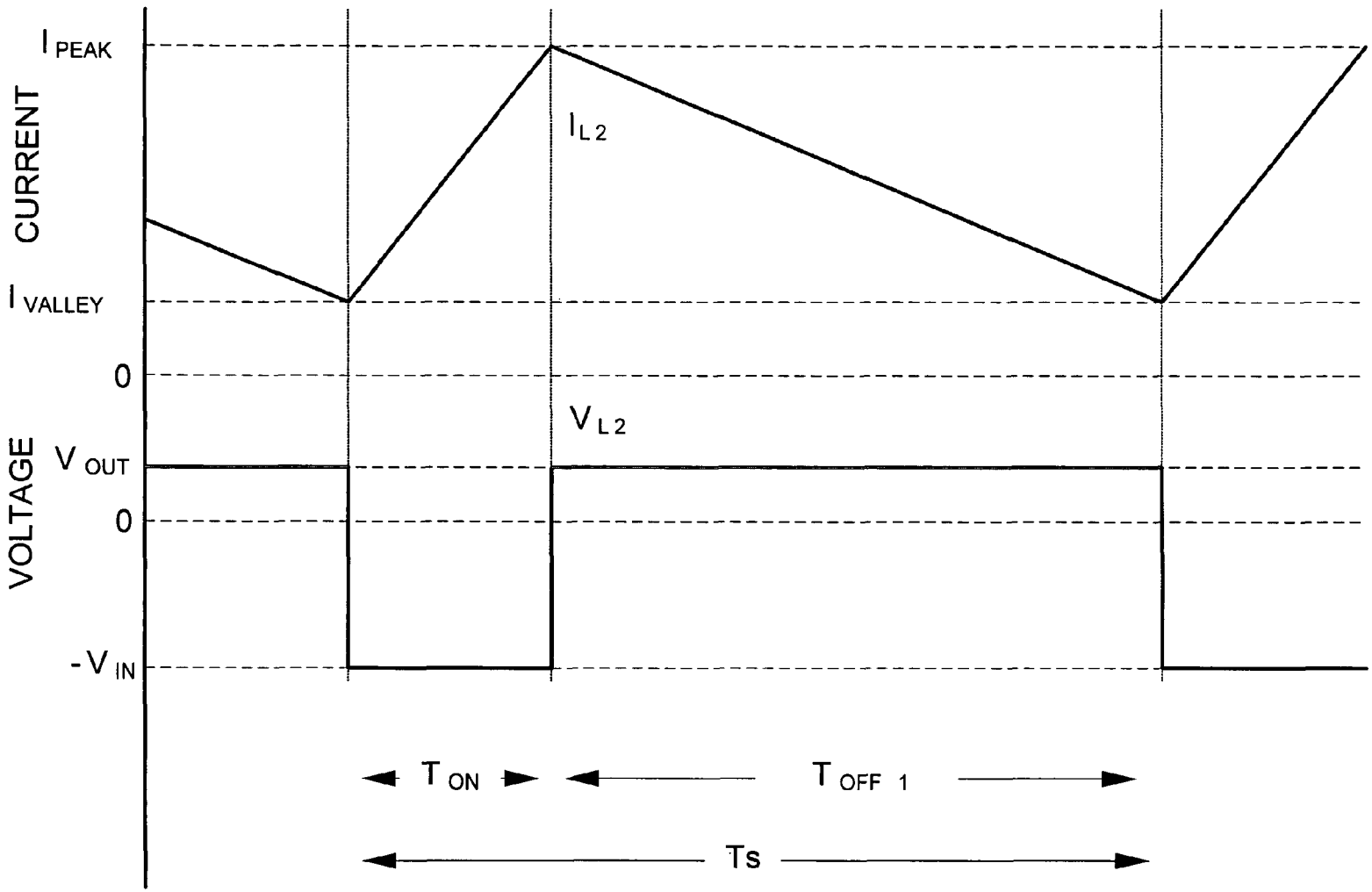
FIG. 3D is a signal diagram showing voltages and currents developed in the SEPIC-type drive circuit of FIG. 3A during the continuous conduction mode of operation.

FIG. 3D is a signal diagram illustrating the operation of the drive circuit 300 in the CCM mode. The output current IOUT is still equal to the average value of the inductor current $\bar{I}_{L2}$ flowing in the inductor L2 during this mode of operation and is given by the following equation:

$$\bar{I}_{L2} = \frac{1}{2}(I_{PEAK} + I_{VALLEY})$$

Figure 4:
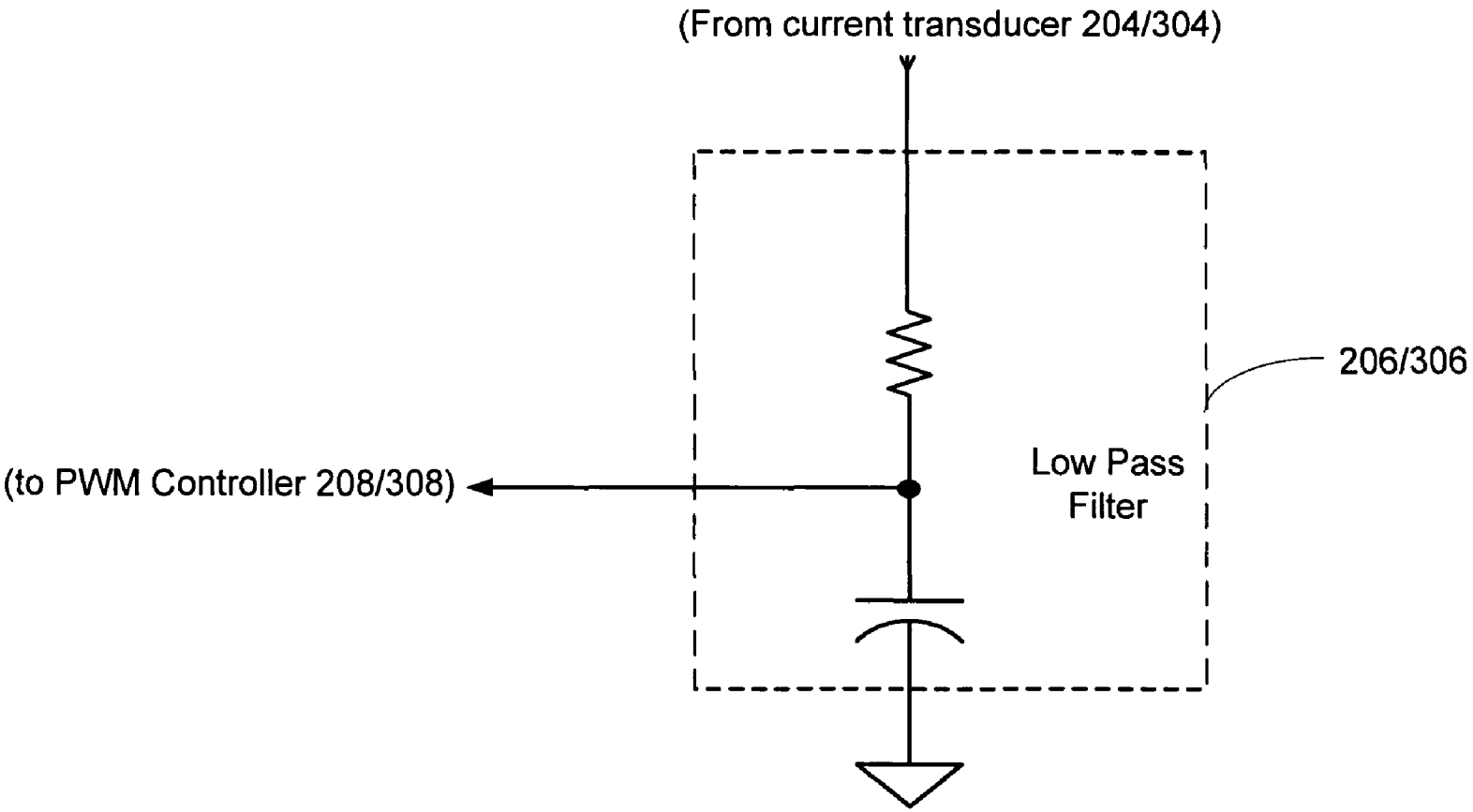
FIG. 4 is a schematic illustrating a low pass filter that may be utilized in place of the averaging or peak detector circuit in the Buck type and SEPIC-type drive circuits of FIGS. 2A and 3A.

Once again, one way of capturing a value for the average inductor current $\bar{I}_{L2}$ is to provide the VFB signal from the current transducer 304 into a low pass filter formed by the detector circuit 306. FIG. 4 is an example of an RC low pass filter that may be utilized for the detector circuits 206/306 of FIGS. 2A and 3A in various embodiments of the present invention.

In the drive circuits 200/300, using the switched currents IQ2 and IL2 to control the output current IOUT through the LEDs 202/302 eliminates the need to monitor this LED current directly. The current transducers 204/304 can monitor the desired switched current at many locations, but the current being monitored is fundamentally either the inductor current IL or the current through an output diode. As long as the monitored switching current represents the current that flows into the output capacitor COUT, it can be used to control the load current.

The previous FIGS. 2A-2C and 3A-3D illustrate how the current can be monitored in two different voltage converter topologies, but embodiments of the present invention should not be construed as being limited to only these topologies, as previously mentioned. Moreover, the location of the current transducer 204/304, although shown in specific locations in each of the described embodiments, is not limited to those locations. There are multiple locations that can be used to monitor the desired switching currents. For example, in the case of transformer coupled voltage converter topologies, the current transducer 204/304 could be located on the primary side rather than the secondary side of the transformer.

In the driver circuits 200/300, the input voltage VIN may be provided by either a DC voltage or an AC voltage source. Where the series-connected LEDs 202/302 are being utilized in a lighting application, an AC voltage source in the form of a rectified AC line voltage would typically supply the input voltage VIN. For these applications, the average current control utilized in the drive circuits 200 and 300 allows power factor correction to be done in a variety of different types of power supply topologies, which in addition to the Buck and SEPIC topologies shown in these example embodiments includes boost, SEPIC, CUK, flyback, Buck-boost, and forward converter topologies. Virtually any topology converter operating from an AC source can achieve power factor correction when operated in discontinuous mode (DCM) or critical conduction mode (CRCM) and using a constant on time control law, where on time refers to the duration that the switching element of topology is conducting.

Achieving acceptable power factor requires that the load, which in this case corresponds to the drive circuit 200/300 itself, appear as a resistor such that the AC voltage and current sinusoidal waveforms are scaled images of each other and in phase. This requirement means that the power transfer from the AC voltage source to the drive circuit 200/300 is not constant over a period of the input voltage signal VIN but instead varies as the amplitude of the sinusoidal input voltage varies over each AC cycle. The LEDs require a constant power (current), however, to provide constant light intensity and color temperature (ignoring temperature effects). This conflict of requirements is resolved by the output capacitor COUT, which stores the energy delivered from the source and delivers it to the load at a more or less constant rate.

The input voltage VIN may be a rectified AC input source or may be from a DC voltage source. Operating the drive circuits 200/300 in the CRCM or DCM mode allows convenient monitoring of the output current IOUT supplied to the load presented by the series-connected LEDs 202/302 by monitoring the current inductor or switching element current as discussed above. In embodiments of the present invention where the input voltage VIN is a DC voltage, there is more flexibility in the particular operating mode in which the drive circuit 200/300 may be operated since there are no restrictions required to achieve power factor correction as is necessary when the input voltage is an AC voltage. For DC input voltage embodiments of the drive circuits 200/300, the circuits can also be operated in the CCM mode. For embodiments where the input voltage VIN is a rectified AC input voltage, the drive circuits 200/300 may also be operated in the CCM mode if power factor correction is not required.

Where the input voltage VIN is an AC voltage, low bandwidth is required for the integrator formed by the resistor R1, capacitor C3, and error amplifier 210/310. This is true because the on-time of the converter (i.e., when the transistor Q1 is turned ON in drive circuit 200 and when transistor Q1 is OFF in drive circuit 300) must be essentially constant during a half-cycle of the AC input voltage VIN in order to achieve acceptable power factor correction. A typical bandwidth (BW) of the integrator is in the range of 10 to 40 Hz. The output voltage of the drive circuits 200/300, in steady state, is determined by the load presented by the series-connected LEDs 202/302. When the current into and out of the output capacitor COUT is equal, the drive circuit 200/300 is in steady state operation and the output voltage VOUT across the output capacitor COUT is a DC voltage with a small component of rectified AC at the frequency of the AC input voltage VIN superimposed on this DC voltage.

In the drive circuits 200/300, the controllers 208/308 may operate as fixed frequency constant on time controllers or may operate as critical conduction mode constant on time controllers with variable frequency. Fixed frequency operation will result in operation in the DCM mode. The inductor value(s) must be matched to the load current IOUT and input voltage VIN when the DCM mode of operation is desired. The constant on time refers to the on time being constant during a half-cycle of the rectified AC input voltage VIN, but the on time will vary slowly over multiple AC cycles of the input voltage VIN if the load current IOUT changes or if a root-mean-square (RMS) value of the AC input voltage VIN changes.

Figure 5:
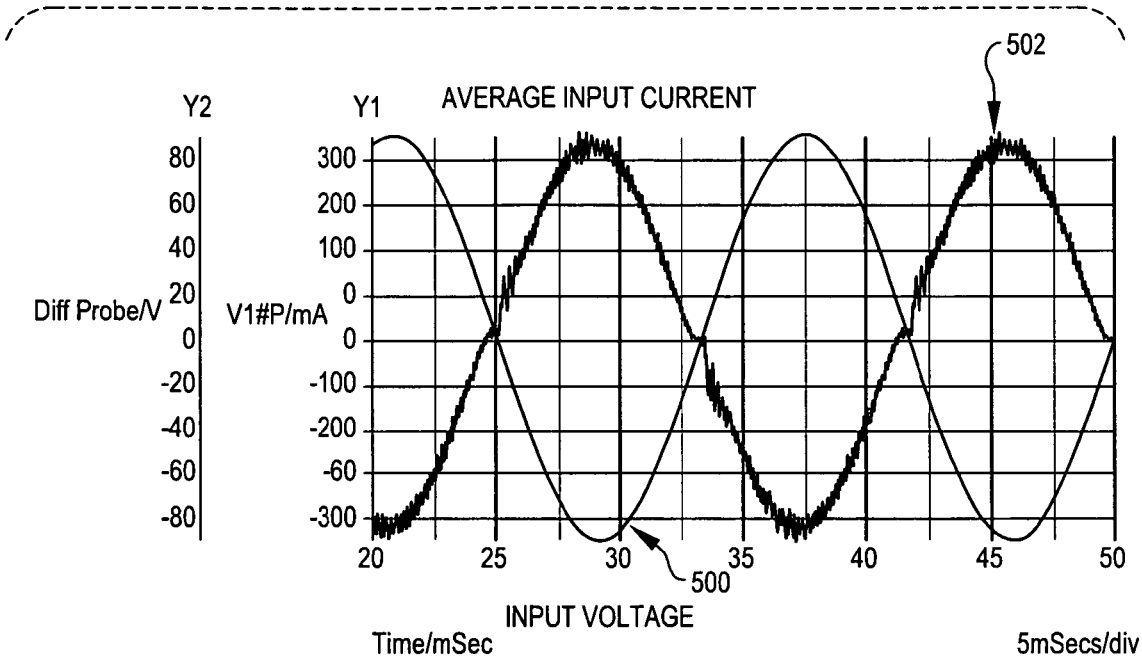
FIG. 5 is signal diagram showing the phase relationship between the input voltage and average input current across the input capacitors in the drive circuits of FIGS. 2A and 3A.

FIG. 5 is a signal diagram showing the phase relationship between the input voltage VIN and average input current across the input capacitor CIN in the drive circuits 200/300. In this figure the input voltage is represented by the waveform 500 while the average input current is represented by the waveform 502. The input voltage waveform 500 has been shifted 180° in FIG. 5 so that each of the wave forms 500 and 502 is more clearly discernible. Accordingly, the wave forms are 180° out of phase in FIG. 5 only because of this 180 degree shift and thus, as is desired for proper power factor correction, these two waveforms are in phase in embodiments of the present invention.

Figure 6:
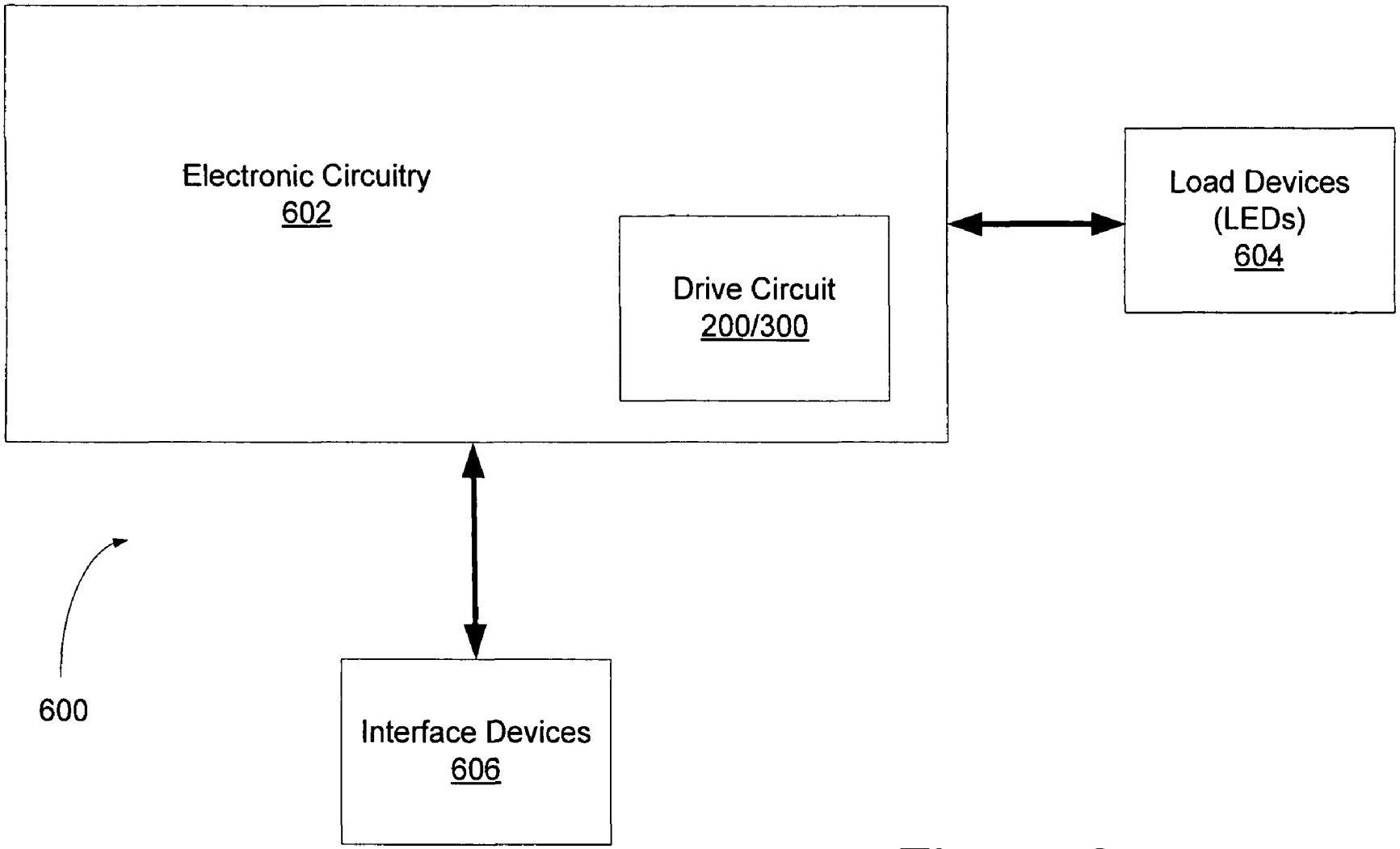
FIG. 6 is a functional block diagram of an electronic system including the Buck-type drive circuit FIG. 2A, SEPIC-type drive circuit of FIG. 3A, or other type of drive circuit according to an embodiment of the present invention.

FIG. 6 is a functional block diagram of an electronic system 600 including the Buck-type drive circuit 200 FIG. 2A, SEPIC-type drive circuit 300 FIG. 3A, or other type of drive circuit according to an embodiment of the present invention. The electronic system 600 includes electronic circuitry 602 which, in turn, contains the drive circuit 200/300. The drive circuit 200/300 drives load devices 604 such as the series-connected LEDs 202/302. The electronic circuitry 602 may correspond to a variety of different types of circuitry depending upon the particular application for which the drive circuit 200/300 is being utilized. For example, in one embodiment the electronic circuitry 602 corresponds to a lighting system. The system 600 further may further include interface devices 606 that may take a variety of different forms and which function to allow a user to interface with the system. For example, where the electronic circuitry 602 is lighting circuitry to interface devices 606 may be switches which allow a user to activate and deactivate the electronic circuitry and drive circuit 200/300 to thereby turn the LEDs 6040N and OFF.

As will be understood by those skilled in the art, virtually any voltage converter topology when operating from an AC input source can achieve power factor correction if operated in the discontinuous mode (DCM) or critical conduction mode (CRCM) and using a constant on time control law. Accordingly, other embodiments of the present invention utilize different converter topologies to form an LED drive circuit. In addition to the Buck and SEPIC converter topologies discussed above, CUK, flyback, Buck-boost, Boost, and forward converter topologies can be utilized in other embodiments of the present invention. This list of converter topologies is not meant to be exhaustive, and additional converter topologies may be utilized in other embodiments of the present invention.

Figure 1:
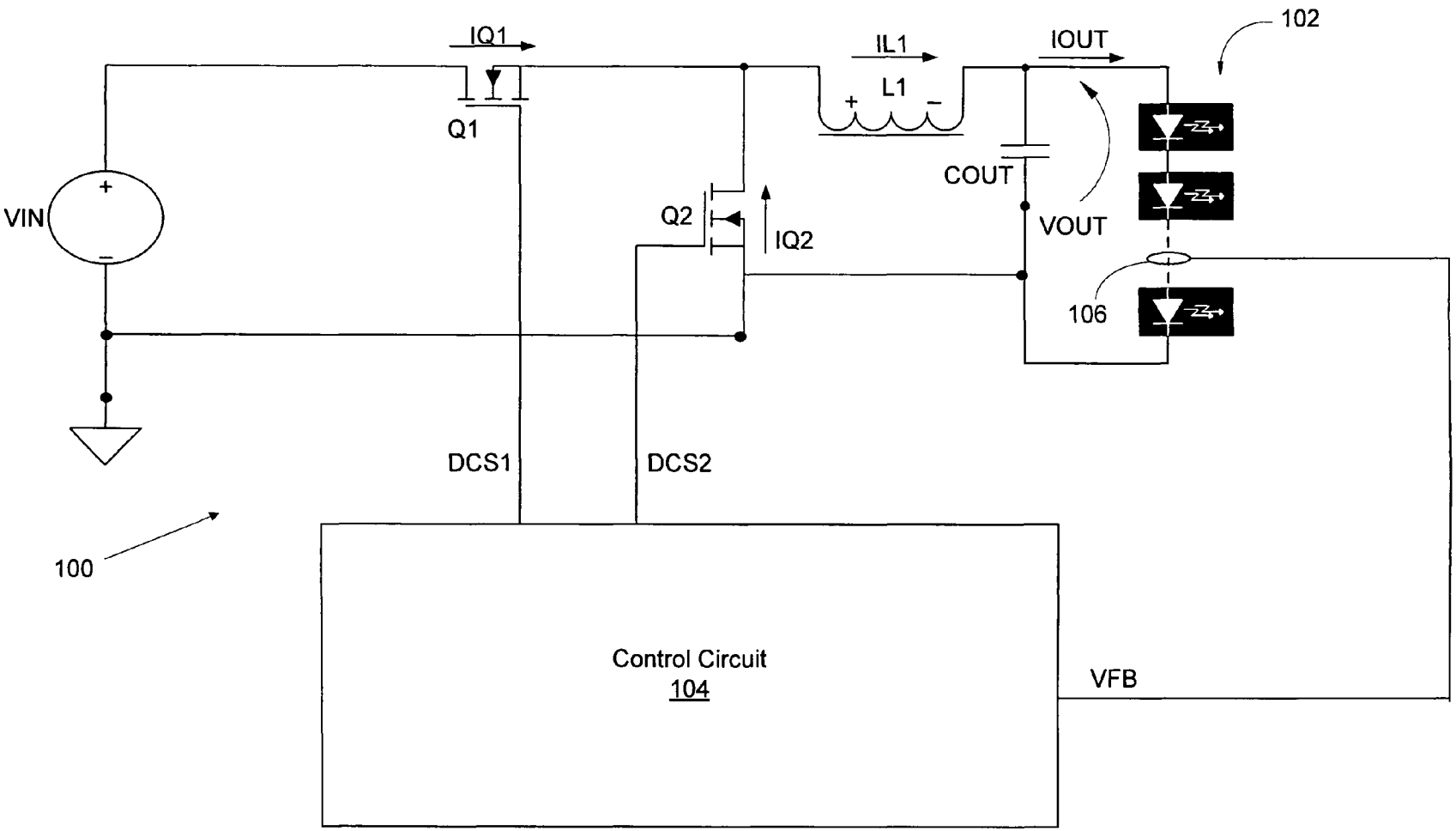
Figure 1 (Background Art)
FIG. 1 is a circuit diagram of a conventional Buck-type drive circuit for driving series-connected LEDs.

Even though various embodiments and advantages of the present invention have been set forth in the foregoing description, the above disclosure is illustrative only, and changes may be made in detail and yet remain within the broad principles of the present invention. Moreover, the functions performed by the elements illustrated and described with reference to FIGS. 1 and 2 may in at least some instances be combined and performed by fewer elements, separated and performed by more elements, or combined into different functional blocks depending upon the actual components used and the LED lighting system being designed, as will be appreciated by those skilled in the art. For example, in the drive circuits 200 and 300 of FIGS. 2 and 3 although single inductors L1 and L2 are shown, these may generally be inductive elements or circuits that may include one or more inductors connected in various configurations. Similarly, the circuits 200 and 300 shows single switching transistors Q1 and Q2 although each of these is generally a switching element that may be formed from a variety of different types of circuits and thus may include more than one transistor along with other components as well. MOS devices are shown for the switching transistors Q1 and Q2 but other types of transistors can be utilized as well. Also note that although the LEDs 202 and 302 are shown and described as being series-connected diodes, this is merely intended to represent the load to which the output current IOUT is being supplied. The load represented by the LEDs 202 and 302 would typically include a large number of LEDs that are connected in series and parallel combinations to provide the desired illumination. Therefore, the present invention is to be limited only by the appended claims.

What is claimed is:

1. A drive circuit operable to supply a drive current to a plurality of light emitting diodes, the drive circuit including a voltage converter circuit having a topology and including at least one inductive element and at least one switching element, the drive circuit operable to sense a current through one of the inductive and switching elements and generate a feedback signal from the sensed current, the feedback signal having a value indicating the drive current being supplied to the light emitting diodes and the drive circuit operable to control the operation of the voltage converter circuit responsive to the feedback signal.

2. The drive circuit of claim 1 wherein each of the switching elements comprises a transistor.

3. The drive circuit of claim 2 wherein each transistor comprises a MOS transistor.

4. The drive circuit of claim 1 wherein the topology of the voltage converter circuit comprises an SEPIC converter topology.

5. The drive circuit of claim 4 wherein the voltage converter circuit includes first and second inductive elements and wherein the drive circuit is operable to sense the current through one of the inductive elements.

6. The drive circuit of claim 1 wherein the topology of the voltage converter circuit comprises a boost converter topology.

7. The drive circuit of claim 1 wherein the topology of the voltage converter circuit comprises a Buck converter topology.

8. The drive circuit of claim 7 wherein the Buck converter includes two switching elements and wherein the drive circuit is operable to sense the current through one of the switching elements.

9. The drive circuit of claim 1 wherein the voltage converter circuit operates in the CRCM mode of operation.

10. The drive circuit of claim 1 wherein the voltage converter circuit is adapted to receive an AC input voltage.

11. The drive circuit of claim 10 wherein the drive circuit is further operable to control the operation of the voltage converter circuit to provide power factor correction during operation of the drive circuit.

12. A drive circuit for supplying a drive current to a plurality of light emitting diodes, the drive circuit comprising:

a switching and energy storage circuit adapted to receive an input voltage, the switching and energy storage circuit including at least one inductive element and at least one switching element and being operable responsive to a control output signal to provide a first current;

an output stage adapted to be coupled to a load, the output stage including at least one capacitive element and being operable to store energy responsive to the first current from the switching and energy storage circuit and operable to supply the drive current to the load; and a control circuit coupled to the switching and energy storage circuit, the control circuit operable to sense a current through one of the inductive and switching elements in the switching and energy storage circuit to obtain an indication of a value of the drive current being supplied to the load, and the control circuit operable responsive to the sensed current to generate pulse width modulated control output signals that are applied to control the operation of the switching and energy storage circuit.

13. A drive circuit for supplying a drive current to a plurality of light emitting diodes, the drive circuit comprising:

a switching and energy storage circuit adapted to receive an input voltage, the switching and energy storage circuit including at least one inductive element and at least one switching element and being operable responsive to a control output signal to provide a first current;

an output stage adapted to be coupled to a load, the output stage including at least one capacitive element and being operable to store energy responsive to the first current from the switching and energy storage circuit and operable to supply the drive current to the load;

a control circuit coupled to the switching and energy storage circuit, the control circuit operable to sense a current through one of the inductive and switching elements in the switching and energy storage circuit and operable responsive to the sensed current to generate pulse width modulated control output signals that are applied to control the operation of the switching and energy storage circuit; and wherein the control circuit is operable to sense the average current through one of the inductive or switching elements in the switching and energy storage circuit.

14. The drive circuit of claim 12 wherein the switching and energy storage circuit has an SEPIC converter topology including a first serial-connected inductive element and a second parallel-connected inductive element and wherein the control circuit senses the average current through the second parallel-connected inductive element.

15. The drive circuit of claim 12 wherein the switching and energy storage circuit control circuit has a Buck converter topology including a first serial-connected switching element and a second parallel-connected switching element and wherein the control circuit senses the average current through the second parallel-connected switching element.

16. The drive circuit of claim 12 wherein the control circuit comprises:

a current transducer coupled to one of the inductive elements or switching elements in the switching and energy storage circuit, the current transducer operable to sense a current flowing through the associated element and to provide a feedback voltage signal having a value that is a function of the sensed current;

a detector circuit coupled to the current transducer to receive the feedback voltage signal, the detector circuit operable to generate an output signal indicating an average value of the sensed current; and pulse width modulation control circuitry coupled to the detector circuit and operable to generate at least one pulse width modulated control output signal responsive to the output signal from the detector circuit, and operable to apply each pulse width modulated control output signal to a corresponding switching element in the switching and energy storage circuit.

17. The drive circuit of claim 16 wherein the detector circuit comprises a low pass filter.

18. The drive circuit of claim 16 wherein the detector circuit determines the average value from detected peak values of the sensed current.

19. A method of controlling a drive current being supplied to a plurality of light emitting diodes, the drive current being generated by a voltage converter circuit including switching and inductive elements and the method comprising:

sensing a current through a selected one of the inductive and switching elements;

determining the average current through the selected one of the inductive and switching elements; and controlling the drive current responsive to the determined average current.

20. The method of claim 19 wherein sensing the current comprises sensing peak values of the current and determining the average current comprises determining the average current from the sensed peak values.

21. A drive circuit for supplying a drive current to a plurality of light emitting diodes, the drive circuit including a voltage converter circuit having a topology and including a first inductive element and a first switching element having associated activation and deactivation times, and wherein the drive circuit is operable to sense a current through the first inductive element during the deactivation time of the first switching element and to generate a feedback signal from the sensed current, the feedback signal having a value indicating the drive current being supplied to the light emitting diodes and the drive circuit operable to control the operation of the voltage converter circuit responsive to the feedback signal.

22. The drive circuit of claim 21, wherein the topology is a Buck converter topology and wherein the voltage converter circuit further comprises a second switching element having associated activation and deactivation times; and wherein the drive circuit is operable to sense a current through the second switching element during the activation time of the second switching element and during the deactivation time of the first switching element, this current through the second switching element corresponding to the current through the first inductive element.

23. The drive circuit of claim 22 wherein the drive circuit is operable to determine the average current through the first inductive element from maximum and minimum values of the sensed current.

24. The drive circuit of claim 22 wherein the drive circuit is operable to determine the average current through the first inductive element from detected activation and deactivation times of control signals applied to the first and second switching elements and from the value of the sensed current through the first inductive element and the duration of a cycle associated with such control signals.

25. The drive circuit of claim 21, wherein the topology is an SEPIC converter topology and wherein the voltage converter circuit further comprises a second inductive element; and wherein the drive circuit is operable to sense a current through the second inductive element during the activation time of the first switching element.

26. The drive circuit of claim 25 wherein the drive circuit is operable to determine the average current through the second inductive element from maximum and minimum values of the sensed current.

27. The drive circuit of claim 25 wherein the drive circuit is operable to determine the average current through the second inductive element from detected activation and deactivation times of a control signal applied to the first switching element and from the value of the sensed current through the second inductive element and the duration of a cycle associated with the control signal.

* * * * *

UNITED STATES PATENT AND TRADEMARK OFFICE

CERTIFICATE OF CORRECTION

PATENT NO. : 7,944,153 B2
APPLICATION NO. : 12/002611
DATED : May 17, 2011
INVENTOR(S) : Fred Greenfeld It is certified that error appears in the above-identified patent and that said Letters Patent is hereby corrected as shown below:

- In Claim 15, Column 12, Line 53 of the patent, "energy storage circuit control circuit has a Buck converter" should read --energy storage circuit has a Buck converter--.

Signed and Sealed this
Twenty-first Day of June, 2011

David J. Kappos

David J. Kappos
*Director of the United States Patent and Trademark Office*